US008408865B2

(12) United States Patent
Sinzaki

(10) Patent No.: US 8,408,865 B2
(45) Date of Patent: Apr. 2, 2013

(54) BLOWER

(75) Inventor: Kouji Sinzaki, Aichi (JP)

(73) Assignee: Panasonic Corporation, Osaka (JP)

( * ) Notice: Subject to any disclaimer, the term of this patent is extended or adjusted under 35 U.S.C. 154(b) by 765 days.

(21) Appl. No.: 12/665,174

(22) PCT Filed: Jun. 27, 2008

(86) PCT No.: PCT/JP2008/001680

§ 371 (c)(1),
(2), (4) Date: Dec. 17, 2009

(87) PCT Pub. No.: WO2009/004775

PCT Pub. Date: Jan. 8, 2009

(65) Prior Publication Data

US 2010/0183425 A1 Jul. 22, 2010

(30) Foreign Application Priority Data

Jul. 2, 2007 (JP) ..... 2007-173684

(51) Int. Cl.
*F04D 29/42* (2006.01)

(52) U.S. Cl. ..... 415/66; 415/201; 415/119; 415/206; 415/213.1; 415/214.1

(58) Field of Classification Search ..... 415/60, 415/66, 119, 201, 206; 416/120, 203
See application file for complete search history.

(56) References Cited

U.S. PATENT DOCUMENTS 6,389,847 B1 * 5/2002 Lehto ..... 65/348

FOREIGN PATENT DOCUMENTS

| | | | |
|---|---|---|---|
| JP | 61-127335 | U | 8/1986 |
| JP | 2001-153418 | | 6/2001 |
| JP | 2004-301447 | | 10/2004 |
| JP | 2005-248934 | | 9/2005 |
| JP | 2005-248934 | A | 9/2005 |
| JP | 2007-092672 | | 4/2007 |
| JP | 2007-092672 | A | 4/2007 |

OTHER PUBLICATIONS

PCT International Search Report of PCT Application No. PCT/2008/001680 dated Jul. 29, 2008.

* cited by examiner

*Primary Examiner* — Ninh H Nguyen
(74) *Attorney, Agent, or Firm* — Panasonic Patent Center

(57) ABSTRACT

A blower apparatus comprises a box-like main frame provided with a main-frame inlet port and a main-frame outlet port in positions confronting each other, and a plurality of centrifugal blower units for suctioning through a blower inlet port air taken inside of the main frame from the main-frame inlet port and discharging the air from a blower air outlet toward the main-frame outlet port. The main frame is provided with a maintenance opening in one of the surfaces other than the surfaces having the main-frame inlet port and the main-frame outlet port for the purpose of checking the inside of the main frame, and the plurality of centrifugal blower units are disposed one another in a direction toward the maintenance opening so that a difference in discharging spatial distances from the blower air outlets of the adjoining centrifugal blower units to the main-frame outlet port is equal to or greater than an outer diameter of an impeller of the centrifugal blower unit located nearest to the maintenance opening.

12 Claims, 4 Drawing Sheets

BLOWER

CROSS-REFERENCE TO RELATED APPLICATIONS

This is a U.S. National Phase Application under 35 U.S.C. Section 371 of PCT/JP2008/001680, filed on Jun. 27, 2008, which claims priority under 35 U.S.C. Section 119(a) to Japanese Patent Application No. 2007-173684 filed in Japan on Jul. 2, 2007, the entire contents of which are incorporated herein by reference.

TECHNICAL FIELD

The present invention relates to a blower apparatus having a plurality of centrifugal blower units disposed inside a duct.

BACKGROUND ART

A blower apparatus of certain kind hitherto known is equipped with centrifugal blower units disposed in parallel to one another and retained by a position restricting member (Patent literature 1, for example).

Referring now to the accompanying drawing, description is provided hereafter of the blower apparatus. FIG. 7 is a plan view showing a structure of the conventional blower apparatus.

As shown in FIG. 7, main frame 101 comprises two pairs of mutually confronted side plates 102, a top plate (not shown) and a bottom plate (not shown). One of side plates 102 is provided with main-frame inlet port 104 for connection with inlet side duct 103, and another of side plates 102 is provided with main-frame outlet port 106 for connection with outlet side duct 105.

A space inside main frame 101 between side plate 102 having main-frame inlet port 104 and another side plate 102 having main-frame outlet port 106 is separated by partition plate 108 provided with openings 107. There are two centrifugal blower units 111 placed in parallel and fixed between partition plate 108 and position restricting member 109 installed on one side of partition plate 108 near side plate 102 having main-frame inlet port 104. Two centrifugal blower units 111 are fixed with their air outlets 110 aligned with openings 107 of partition plate 108.

These centrifugal blower units 111 can be removed one after another from the front side by disengaging position restricting member 109 through maintenance opening 112 provided in one of side plates 102 of main frame 101.

In the conventional blower apparatus of this type, centrifugal blower units 111 can be removed one after another from the front side by disengaging position restricting member 109 through maintenance opening 112 provided in one of side plates 102 of main frame 101. It is necessary, however, that both of these centrifugal blower units 111 are to be removed one by one from the front side even when only one of centrifugal blower units 111 located at the far backside of main frame 101 needs to be checked, because of the structure that two centrifugal blower units 111 are placed in parallel to each other between partition plate 108 and position restricting member 109. The above structure thus has a drawback of requiring an extra time and effort in order to remove both of centrifugal blower units 111.

Patent Literature 1: Japanese Utility Model Unexamined Publication, No. 1986-127335

SUMMARY OF THE INVENTION

The present invention covers a blower apparatus comprising a main frame of a box-like shape provided with a main-frame inlet port for taking in air and a main-frame outlet port for delivering the air in side surfaces confronting each other, and a plurality of centrifugal blower units for suctioning through blower inlet ports the air taken inside of the main frame from the main-frame inlet port and discharging the air from blower air outlets toward the main-frame outlet port, wherein the main frame is provided with a maintenance opening in one of the surfaces other than the side surfaces having the main-frame inlet port and the main-frame outlet port for the purpose of checking the inside of the main frame, and the plurality of centrifugal blower units are disposed one another in a direction toward the maintenance opening in a manner that a difference in discharging spatial distances from the blower air outlets of the adjoining centrifugal blower units to the main-frame outlet port is equal to or greater than an outer diameter of an impeller of the centrifugal blower unit located nearest to the maintenance opening.

The blower apparatus of this structure does not require removal of any of the plurality of centrifugal blower units since the maintenance opening can make all of them accessible for their maintenance individually. The structure can thus save a considerable time and effort for the maintenance work of the blower apparatus.

REFERENCE MARKS IN THE DRAWINGS

Figure 1:
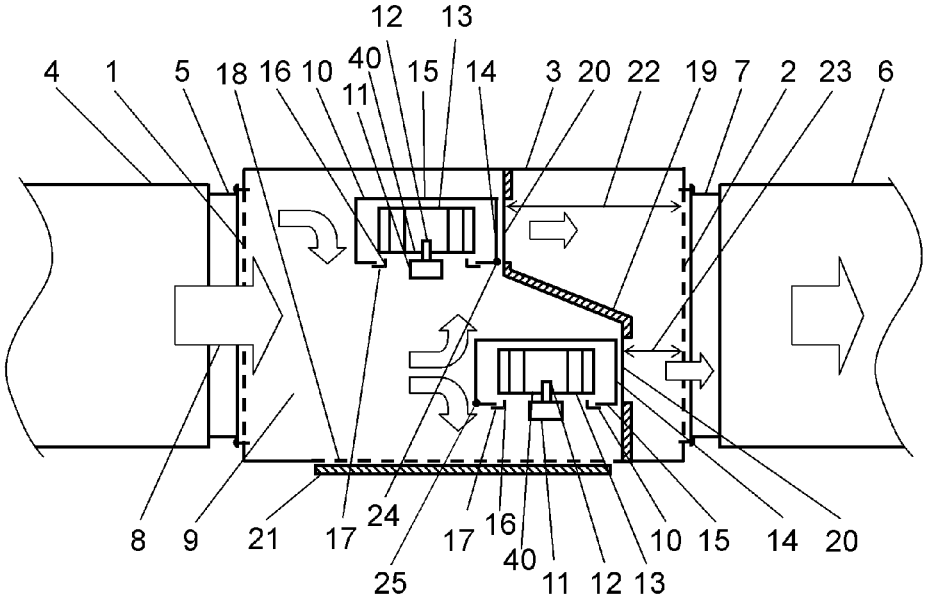
FIG. 1 is a plan view showing a structure of a blower apparatus according to a first exemplary embodiment of the present invention.

1 Main-frame inlet port
2 Main-frame outlet port
3 Main frame
8 Main-frame airflow
10 Centrifugal blower unit
11 Motor
13 Impeller
14 Blower air outlet
15 Scroll casing
16 Motor-side casing inlet
18 Maintenance opening
19 Partition plate
20 Opening
22, 23 Discharging spatial distance
24 Scroll-casing outlet end
25 Scroll-casing inlet end
32 Anti-motor side casing inlet
33 Sound absorbing material
34 Sound absorbing material fixing plate

40 Blower air inlet
41 Back plate

DETAILED DESCRIPTION OF PREFERRED EMBODIMENTS

Description is provided hereafter of the preferred embodiments of the present invention with reference to the accompanying drawings.

First Exemplary Embodiment

FIG. 1 is a plan view showing a structure of a blower apparatus according to the first exemplary embodiment of the present invention. Main frame 3 of a box-like shape is provided with main-frame inlet port 1 for taking air and main-frame outlet port 2 for delivering the air in side surfaces confronting each other. Box-like main frame 3 is also provided with inlet adaptor 5 around main-frame inlet port 1 for connection with inlet-side duct 4 and outlet adaptor 7 around main-frame outlet port 2 for connection with outlet side duct 6.

Box-like main frame 3 has air path 9 in it for guiding main-frame air flow 8 from main-frame inlet port 1 to main-frame outlet port 2. Box-like main frame 3 is equipped with a plurality of centrifugal blower units 10 having scroll casing 15 of a volute shape for suctioning through blower inlet port 40 the air taken from main-frame inlet port 1 and discharging the air from blower air outlet 14 toward main-frame outlet port 2. The blower apparatus described here in the first exemplary embodiment of this invention is an example equipped with two centrifugal blower units 10.

Each of centrifugal blower units 10 comprises impeller 13 fixed to motor 11 via driving shaft 12, blower air outlet 14 confronting main-frame outlet port 2, and volute shape scroll casing 15. Scroll casing 15 has motor-side orifice 17 forming motor-side casing inlet 16 on one side thereof.

Box-like main frame 3 is provided with maintenance opening 18 in one of the surfaces other than the side surfaces having main-frame inlet port 1 and main-frame outlet port 2 for the purpose of making the inside of main frame 3 accessible for inspection. Box-like main frame 3 is also provided with partition plate 19 dividing the interior into two spaces, one at main-frame inlet port 1 side and the other at main-frame outlet port 2 side, and two centrifugal blower units 10 are disposed in positions shifted from each other in a direction parallel to maintenance opening 18. When main frame 3 has a hexahedral shape, for instance, maintenance opening 18 is formed in one of the four surfaces other than the surfaces having main-frame inlet port 1 and main-frame outlet port 2.

Partition plate 19 has openings 20, to which blower air outlets 14 of the centrifugal blower units are connected individually. Two centrifugal blower units 10 are so disposed that their driving shafts 12 are orthogonal to maintenance opening 18, on which maintenance panel 21 is attached in a freely removable manner.

Here, positions where two centrifugal blower units 10 are disposed are determined in a manner as described below. A distance from blower air outlet 14 of one centrifugal blower unit 10 on the far side from maintenance opening 18 to main-frame outlet port 2 and another distance from blower air outlet 14 of another centrifugal blower unit 10 on the near side to maintenance opening 18 to main-frame outlet port 2 are denoted as discharging spatial distances 22 and 23 respectively. In this embodiment, a difference between discharging spatial distances 22 and 23 is set to be equal to or greater than an outer diameter of impeller 13 of centrifugal blower unit 10 located on the near side to maintenance opening 18.

When three or more centrifugal blower units 10 are used, their positions are shifted from one another in such a manner that a difference in the discharging spatial distances from blower air outlets 14 of the adjoining centrifugal blower units 10 to main-frame outlet port 2 becomes equal to or greater than the outer diameter of impeller 13 of centrifugal blower unit 10 located nearest to maintenance opening 18.

In addition, centrifugal blower units 10 are so disposed that scroll-casing outlet end 24 facing main-frame outlet port 2 of any of centrifugal blower units 10 located further from maintenance opening 18 and scroll-casing inlet end 25 facing main-frame inlet port 1 of another one of centrifugal blower units 10 located nearer to maintenance opening 18 are overlapped along the direction of main-frame airflow 8.

Figure 2:
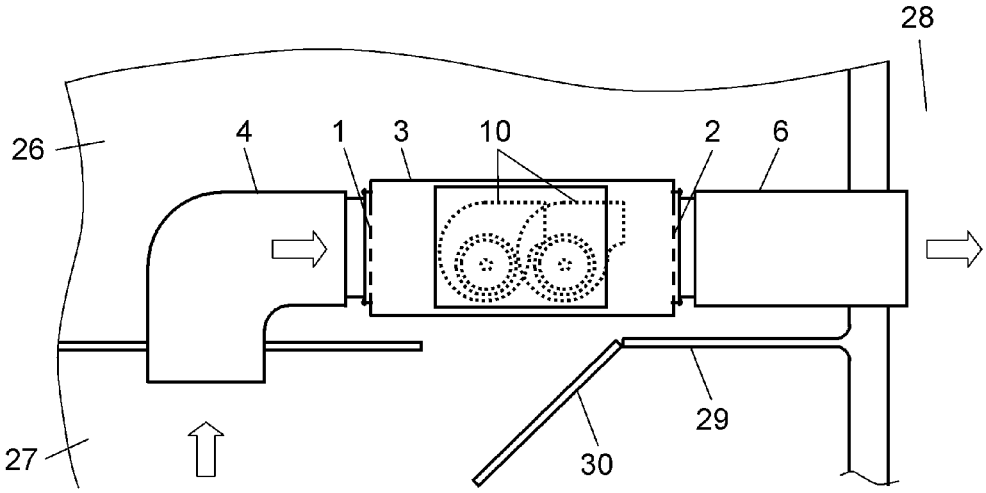
FIG. 2 is a side view showing the structure of the blower apparatus as it is installed.

FIG. 2 is a side view of the blower apparatus according to the first exemplary embodiment of this invention, showing a structure as it is installed. Box-like main frame 3 is mounted in ceiling space 26 by connecting inlet side duct 4 to main-frame inlet port 1 and outlet side duct 6 to main-frame outlet port 2. When centrifugal blower units 10 are driven, the air inside room 27 is exhausted to outdoor 28 by passing through inlet side duct 4, centrifugal blower units 10 and outlet side duct 6. Ceiling board 29 separates ceiling space 26 from room 27, and it is provided with inspection door 30 underneath box-like main frame 3.

During maintenance of the blower apparatus, it becomes possible by virtue of the above structure to check visually through maintenance opening 18 the two impellers 13 of centrifugal blower units 10 on both the further side and the nearer side of maintenance opening 18 when maintenance panel 21 is removed from box-like main frame 3. This structure can thus allow positive inspection of dust, operating condition and the like of the individual impellers 13.

In other words, this structure makes it unnecessary to remove all of centrifugal blower units 10 since they can be checked individually from maintenance opening 18. It can hence save a considerable time and effort for the maintenance work of the blower apparatus.

Furthermore, this structure eases visual inspection of the individual centrifugal blower units 10 since they are disposed in such an orientation that driving shafts 12 are orthogonal to maintenance opening 18.

In addition, this structure can shorten spatial distance 22 for the air to travel from centrifugal blower unit 10 located on the further side from maintenance opening 18 by an extent that scroll-casing outlet end 24 of centrifugal blower unit 10 on the further side from maintenance opening 18 and scroll-casing inlet end 25 of the other centrifugal blower unit 10 on the near side to maintenance opening 18 are disposed overlapped along the direction of main-frame airflow 8.

Moreover, since the plurality of centrifugal blower units 10 are disposed inside box-like main frame 3, this single unit of blower apparatus can generate as large a quantity of airflow as a total quantity of the number of centrifugal blower units 10, thereby eliminating the need to increase the size of centrifugal blower units 10 and to make box-like main frame 3 low and compact in height approximately equal to that of just one centrifugal blower unit 10.

There is a tendency in recent years toward reducing heights of ceiling spaces 26 in order to increase living spaces in rooms 27. This brings about the need for making the blower apparatus easier to maintain even when installed in ceiling space 26 of narrow and a limited working space.

According to the first exemplary embodiment, as described above, the blower apparatus of the present invention allows maintenance of the two centrifugal blower units individually and easily from the maintenance opening while also achieving compactness of the main frame in both the height and the length in the direction of airflow without impairing the maintainability.

It shall be noted that discharging spatial distance 22 of centrifugal blower unit 10 on the further side from maintenance opening 18 and discharging spatial distance 23 of centrifugal blower unit 10 on the nearer side may be of any values as long as they have such a positional relation as to provide a sufficient space for visual inspection of generally the entire aspects of two centrifugal blower units 10 through maintenance opening 18. It is therefore not necessary for the difference between discharging spatial distances 22 and 23 to be equal to or greater than the outer diameter of impeller 13.

Second Exemplary Embodiment

Figure 3:
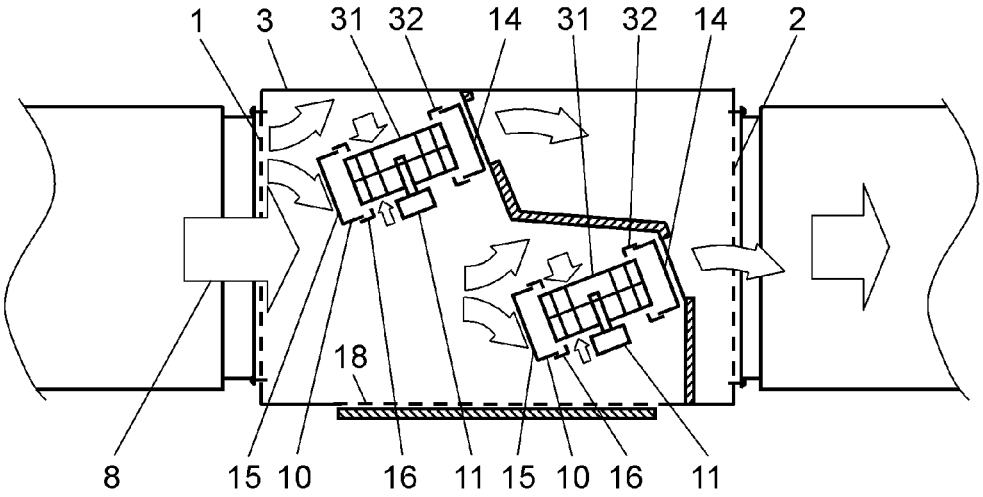
FIG. 3 is a plan view showing a structure of a blower apparatus according to a second exemplary embodiment of the present invention.

FIG. 3 is a plan view showing a structure of a blower apparatus according to the second exemplary embodiment of the present invention. Like reference marks are used throughout to designate like components of the blower apparatus in this exemplary embodiment of the invention as those of the blower apparatus of the first exemplary embodiment, and their details will be omitted.

As shown in FIG. 3, centrifugal blower units 10 are disposed with their motors 11 at the side confronting maintenance opening 18, and either one or both of centrifugal blower units 10 have front surfaces of their blower air outlets 14 tilted with respect to the surface of main-frame outlet port 2. In other words, centrifugal blower units 10 are so tilted that their driving shafts have a given angle to the surface of main-frame outlet port 2. When centrifugal blower units 10 are of double suction type provided with double suction impellers 31, centrifugal blower units 10 are arranged in a manner that their anti-motor side casing inlets 32 are tilted toward main-frame inlet port 1.

The above structure allows visual inspection of motors 11 through maintenance opening 18. In addition, the structure helps reduce a mounting space between centrifugal blower units 10 in the direction of main-frame airflow 8 by an extent of their angles of tilting, thereby shortening the length of box-like main frame 3. This structure also helps divide main-frame airflow 8 smoothly and reduces a pressure loss attributed to collision of the air flow against scroll casings 15 of centrifugal blower units 10 since the round edges of scroll casings 15 are oriented diagonally with respect to main-frame airflow 8 from main-frame inlet port 1.

Moreover, because of the structure having anti-motor side casing inlets 32 tilted toward main-frame inlet port 1, it also reduces a pressure loss in the air paths to anti-motor side casing inlets 32 where motors 11 are not present and a quantity of airflow is larger than motor side casing inlets 16 posing an adverse influence of resistance to the intake air due to collision of the air with motors 11.

A similar advantage is also achievable even when only one of two centrifugal blower units 10 is disposed in the tilted manner.

According to the second exemplary embodiment described above, the blower apparatus of the present invention can improve the maintainability of motors 11 while also achieving compactness in the length of box-like main frame 3 in the direction of main-frame airflow 8, and reduces an input power to centrifugal blower units 10.

Third Exemplary Embodiment

Figure 4:
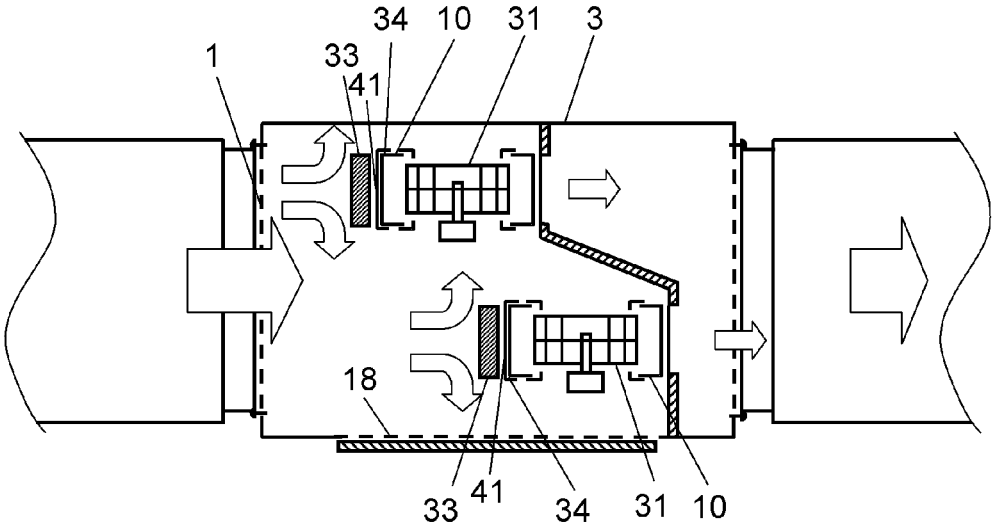
FIG. 4 is a plan view showing a structure of a blower apparatus according to a third exemplary embodiment of the present invention.

FIG. 4 is a plan view showing a structure of a blower apparatus according to the third exemplary embodiment of the present invention. Like reference marks are used throughout to designate like components of the blower apparatus in this exemplary embodiment of the invention as those of the blower apparatuses of the first and the second exemplary embodiments, and their details will be omitted.

As shown in FIG. 4, the blower apparatus according to the third exemplary embodiment of this invention comprises centrifugal blower units 10, each equipped with double suction type impeller 31, and sound absorbing materials 33 fixed to sound absorbing material fixing plates 34 for absorbing airflow noise, which are attached in a removable manner to back plates 41 at one side of centrifugal blower units 10 confronting main frame inlet port 1.

The above structure can absorb the airflow noise in the air path at the inlet port side, and sound absorbing material fixing plate 34 can be removed from centrifugal blower unit 10 on the nearer side to maintenance opening 18 if needed during maintenance of the apparatus. As a result, it becomes possible to check visually not only centrifugal blower unit 10 on the nearer side to maintenance opening 18 but also the other centrifugal blower unit 10 away from maintenance opening 18 when the interior of box-like main frame 3 is observed through maintenance opening 18. In addition, removal of sound absorbing material 33 can provide an additional space for the maintenance work.

According to the third exemplary embodiment described above, the blower apparatus of the present invention can reduce the noise at the side confronting main-frame inlet port 1, and improve the maintainability.

Notwithstanding the above, sound absorbing material fixing plates 34 may be fixed to back plates 41.

Fourth Exemplary Embodiment

Figure 5:
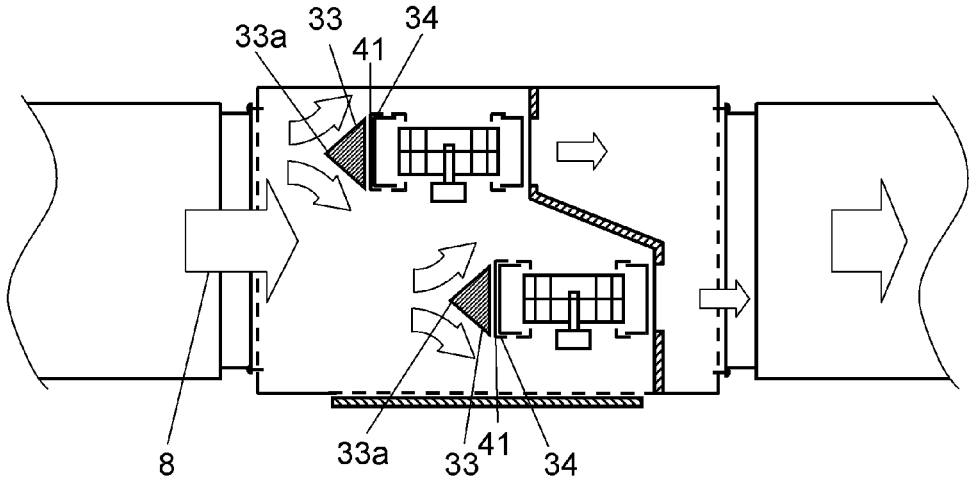
FIG. 5 is a plan view showing a structure of a blower apparatus according to a fourth exemplary embodiment of the present invention.

FIG. 5 is a plan view showing a structure of a blower apparatus according to the fourth exemplary embodiment of the present invention. Like reference marks are used throughout to designate like components of the blower apparatus in this exemplary embodiment of the invention as those of the blower apparatuses of the first to the third exemplary embodiments, and their details will be omitted.

As shown in FIG. 5, sound absorbing materials 33 fixed to sound absorbing material fixing plates 34 have generally a triangular shape in cross section, and they are so disposed that their tips 33*a* point to main-frame inlet port 1.

The above structure uses tips 33*a* of sound absorbing materials 33 to divide main-frame airflow 8 and suppress air turbulence attributed to collision of main-frame air flow 8 against sound absorbing materials 33, thereby reducing a pressure loss in the air path from main-frame inlet port 1.

According to this fourth exemplary embodiment described above, the blower apparatus of the present invention can reduce the noise at the side confronting main-frame inlet port 1, and reduce an input power to centrifugal blower units 10.

Fifth Exemplary Embodiment

Figure 6:
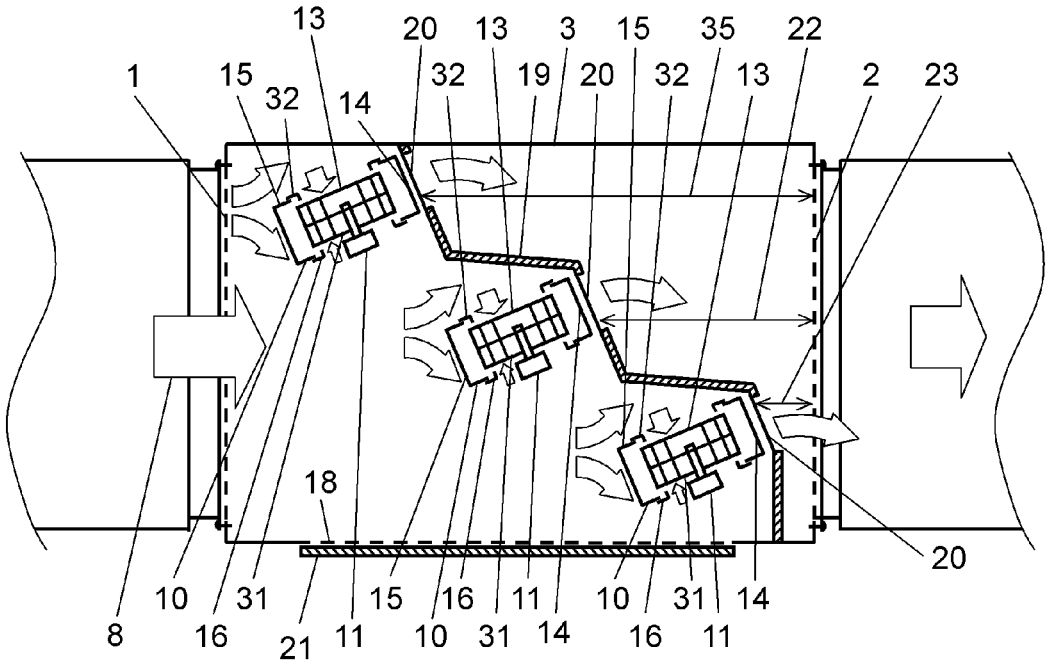
FIG. 6 is a plan view showing a structure of a blower apparatus according to a fifth exemplary embodiment of the present invention.
Figure 7:
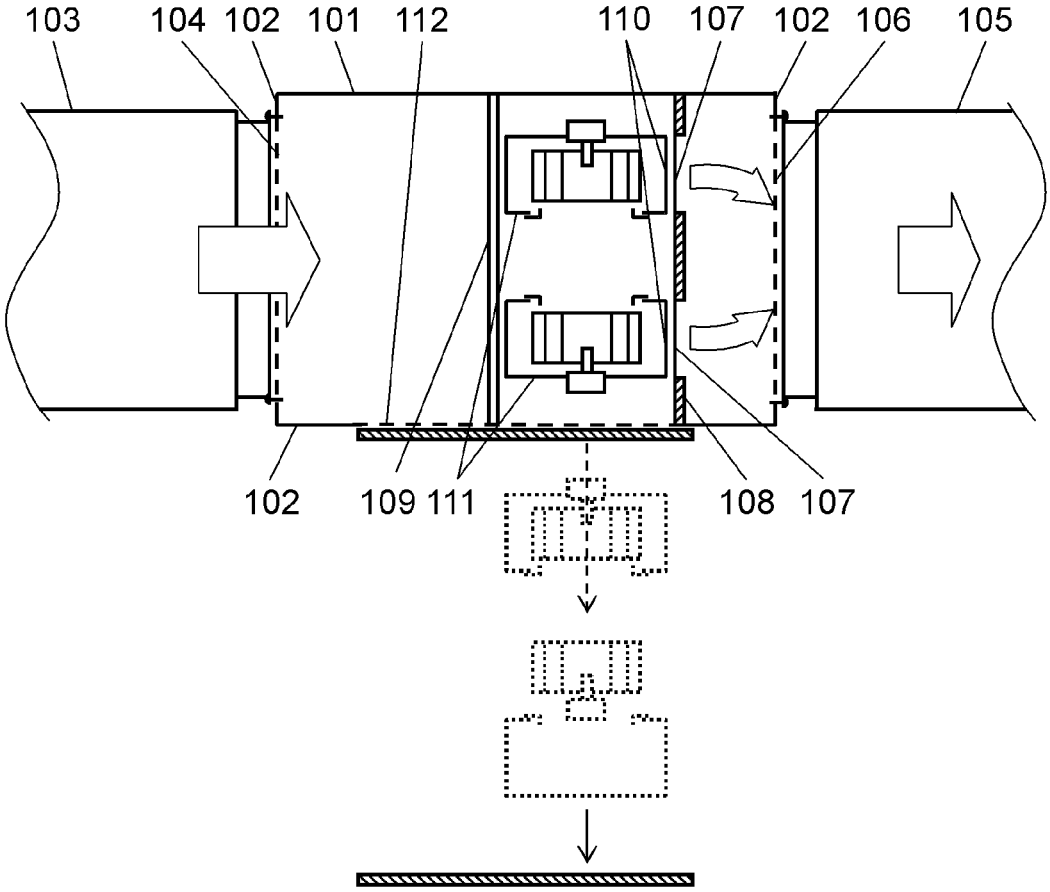
FIG. 7 PRIOR ART
FIG. 7 is a plan view showing a structure of a conventional blower apparatus.

FIG. 6 is a plan view showing a structure of a blower apparatus according to the fifth exemplary embodiment of the present invention. Like reference marks are used throughout to designate like components of the blower apparatus in this exemplary embodiment of the invention as those of the blower apparatuses of the first to the fifth exemplary embodiments, and their details will be omitted.

As shown in FIG. 6, the blower apparatus has box-like main frame 3 provided with maintenance opening 18 in one of the surfaces other than the side surfaces having main-frame inlet port 1 and main-frame outlet port 2. Box-like main frame 3 is also provided with partition plate 19 dividing the interior into two spaces, one at main-frame inlet port 1 side and the other at main-frame outlet port 2 side, and three centrifugal blower units 10 are disposed in positions shifted from one another in a direction parallel to maintenance opening 18. Partition plate 19 has openings 20, to which blower air outlets 14 of the centrifugal blower units are connected individually. Maintenance opening 18 is provided with maintenance panel 21, which is attached to it in a freely removable manner.

Here, discharging spatial distance 22 denotes a distance from blower air outlet 14 of centrifugal blower unit 10 located in the second furthest from maintenance opening 18 to main-frame outlet port 2. Likewise, discharging spatial distance 23 denotes a distance from blower air outlet 14 of centrifugal blower unit 10 on the nearest side to maintenance opening 18 to main-frame outlet port 2, and discharging spatial distance 35 denotes another distance from blower air outlet 14 of centrifugal blower unit 10 on the furthest side from maintenance opening 18 to main-frame outlet port 2.

A difference between discharging spatial distances 22 and 23 is set to be equal to or greater than an outer diameter of impeller 13 of centrifugal blower unit 10 located on the nearest side to maintenance opening 18. Moreover, a difference between discharging spatial distances 23 and 35 is set to be equal to or greater than an outer diameter of impeller 13 of another centrifugal blower unit 10 located on the second furthest from maintenance opening 18. Thus, three sets of centrifugal blower unit 10 are disposed in the above manner within box-like main frame 3.

Centrifugal blower units 10 are disposed with their motors 11 at the side confronting maintenance opening 18 and front surfaces of their blower air outlets 14 tilted with respect to the surface of main-frame outlet port 2. Centrifugal blower units 10 are of the double suction type provided with double suction impellers 31, and these three units are so arranged that their anti-motor side casing inlets 32 be tilted toward main-frame inlet port 1.

During maintenance of the blower apparatus, it becomes possible by virtue of the above structure to check visually the impellers 13 of all centrifugal blower units 10 through maintenance opening 18 when maintenance panel 21 is removed from box-like main frame 3. This structure can hence allow visual inspection of dust, operating condition and the like of the individual impellers 13 of all three centrifugal blower units 10.

The above structure also allows visual inspection of motors 11 through maintenance opening 18. In addition, the structure helps reduce a mounting space between centrifugal blower units 10 in the direction of main-frame airflow 8 by an extent of their angles of tilting, thereby shortening the length of box-like main frame 3. This structure also helps divide main-frame airflow 8 smoothly and reduces a pressure loss attributed to collision of the air flow against scroll casings 15 of centrifugal blower units 10 since the round edges of scroll casings 15 are oriented diagonally with respect to main-frame airflow 8 from main-frame inlet port 1.

Moreover, because of the structure having anti-motor side casing inlets 32 tilted toward main-frame inlet port 1, it also reduces a pressure loss in the air paths to anti-motor side casing inlets 32 where motors 11 are not present and a quantity of airflow is larger than motor side casing inlets 16 posing an adverse influence of resistance to the intake air due to collision of the air with motors 11.

Furthermore, since the plurality of centrifugal blower units 10 are disposed inside box-like main frame 3, this single unit of blower apparatus can generate as large a quantity of airflow as a total quantity of the number of centrifugal blower units 10, thereby eliminating the need to increase the size of centrifugal blower units 10 and to keep the height of box-like main frame 3 approximately equal to that of just one centrifugal blower unit 10.

A similar advantage is also achievable even when four or more centrifugal blower units are used, and even when some of the plurality of centrifugal blower units 10 are not disposed in the tilted manner.

According to the fifth exemplary embodiment, as described above, the blower apparatus of the present invention allows maintenance of the plurality of centrifugal blower units 10 individually and easily from the maintenance opening. As a result, this fifth exemplary embodiment of the present invention can achieve the blower apparatus of compact size and low height provided with the main frame of short length in the direction of airflow while still maintaining the good maintainability.

INDUSTRIAL APPLICABILITY

The blower apparatus of the present invention is capable of cooling equipment of various kinds by using a flow of air delivered from the main-frame outlet port, in addition to the prime purpose of providing the air flow for such apparatuses as ventilation blower, air conditioner, dehumidifier, humidifier and air cleaner. This blower apparatus is also useful for ventilating air in any apparatus requiring compact installation and high cooling efficiency by ensuring a sufficient quantity of airflow with a low pressure loss.

The invention claimed is:

1. A blower apparatus comprising:

a main frame of a box-like shape provided with a main-frame inlet port and a main-frame outlet port in side surfaces confronting each other, the main-frame inlet port for taking in air and the main-frame outlet port for delivering the air; and a plurality of centrifugal blower units for suctioning the air taken inside of the main frame from the main-frame inlet port, through a blower inlet port, and for discharging the air from a blower air outlet toward the main-frame outlet port, wherein the main frame is provided with a maintenance opening in one of surfaces other than the side surfaces having the main-frame inlet port and the main-frame outlet port for the purpose of checking the inside of the main frame, the main frame is provided with a partition plate having a plurality of openings corresponding to the plurality of centrifugal blower units, the partition plate arranged facing the main-frame outlet port and includes an offset portion between the plurality of centrifugal blower units, and the plurality of centrifugal blower units are disposed one another in a direction toward the maintenance opening in a manner that a difference in discharging spatial distances from the blower air outlets of the adjoining centrifugal blower units to the main-frame outlet port is equal to or greater than an outer diameter of an impeller of the centrifugal blower unit located nearest to the maintenance opening.

2. The blower apparatus of claim 1, wherein driving shafts of the centrifugal blower units are disposed orthogonal to the maintenance opening.

3. The blower apparatus of claim 2, wherein two sets of the centrifugal blower units are disposed in a manner that a scroll-casing outlet end facing the main-frame outlet port of one of the centrifugal blower units located further from the maintenance opening and a scroll-casing inlet end facing the main-frame inlet port of the other centrifugal blower unit located nearer to the maintenance opening are overlapped along a direction of airflow in the main frame.

4. The blower apparatus of claim 1, wherein each of the blower units has a front surface tilted with respect to a surface of the main-frame outlet port.

5. The blower apparatus of claim 1, wherein each of the blower units are disposed in a scroll casing, and a length from a beginning and end of the offset portion in a direction of airflow is less than a longest length of each of the scroll casings.

6. A blower apparatus comprising:

a main frame of a box-like shape provided with a main-frame inlet port and a main-frame outlet port in side surfaces confronting each other, the main-frame inlet port for taking in air and the main-frame outlet port for delivering the air;

a plurality of centrifugal blower units for suctioning the air taken inside of the main frame from the main-frame inlet port, through a blower inlet port, and for discharging the air from a blower air outlet toward the main-frame outlet port; and a sound absorbing material for absorbing airflow noise, the sound absorbing material disposed on a back plate at the centrifugal blower unit confronting the main-frame inlet port, fixed to a sound absorbing material fixing plate, attached in a removable manner to the back plate at the centrifugal blower unit confronting the main-frame inlet port, and is of a triangular shape in cross section, and disposed with a tip pointing to the main-frame inlet port, wherein the main frame is provided with a maintenance opening in one of surfaces other than the side surfaces having the main-frame inlet port and the main-frame outlet port for the purpose of checking the inside of the main frame, the plurality of centrifugal blower units are disposed one another in a direction toward the maintenance opening in a manner that a difference in discharging spatial distances from the blower air outlets of the adjoining centrifugal blower units to the main-frame outlet port is equal to or greater than an outer diameter of an impeller of the centrifugal blower unit located nearest to the maintenance opening.

7. A blower apparatus comprising:

a main frame of a box-like shape provided with a main-frame inlet port and a main-frame outlet port in side surfaces confronting each other, the main-frame inlet port for taking in air and the main-frame outlet port for delivering the air; and a plurality of centrifugal blower units for suctioning the air taken inside of the main frame from the main-frame inlet port, through a blower inlet port, and for discharging the air from a blower air outlet toward the main-frame outlet port, wherein the main frame is provided with a maintenance opening in one of surfaces other than the side surfaces having the main-frame inlet port and the main-frame outlet port, and the main frame is provided with a partition plate having a plurality of openings corresponding to the plurality of centrifugal blower units, the partition plate arranged facing main-frame outlet port and includes an offset portion between the plurality of centrifugal blower units, and the plurality of centrifugal blower units are disposed one another in a direction toward the maintenance opening in a manner that a difference in discharging spatial distances from the blower air outlets of the adjoining centrifugal blower units to the main-frame outlet port is equal to or greater than an outer diameter of an impeller of the centrifugal blower unit located nearest to the maintenance opening;

wherein at least two sets of the plurality of centrifugal blower units are disposed in a manner that a scroll-casing outlet end facing the main-frame outlet port of one of the centrifugal blower units located further from the maintenance opening and a scroll-casing inlet end facing the main-frame inlet port of the other centrifugal blower unit located nearer to the maintenance opening are overlapped along a direction of airflow in the main frame.

8. The blower apparatus of claim 7 further comprising:

a sound absorbing material for absorbing airflow noise, the sound absorbing material disposed on a back plate at the centrifugal blower unit confronting the main-frame inlet port.

9. The blower apparatus of claim 8, wherein the sound absorbing material is fixed to a sound absorbing material fixing plate, and the sound absorbing material fixing plate is attached in a removable manner to the back plate at the centrifugal blower unit confronting the main-frame inlet port.

10. The blower apparatus of claim 7, further comprising a sound absorbing material for absorbing airflow noise, wherein the sound absorbing material is of a triangular shape in cross section, and disposed with a tip pointing to the main-frame inlet port.

11. The blower apparatus of claim 7, wherein each of the blower units has a front surface tilted with respect to a surface of the main-frame outlet port.

12. The blower apparatus of claim 7, wherein each of the blower units are disposed in a scroll casing, and a length from a beginning and end of each of the offset portions in a direction of airflow is less than a longest length of each of the scroll casings.

* * * * *